US009566491B1

(12) United States Patent
English

(10) Patent No.: US 9,566,491 B1
(45) Date of Patent: Feb. 14, 2017

(54) BOXING TRAINING DEVICE

(71) Applicant: Greg English, Binghamton, NY (US)

(72) Inventor: Greg English, Binghamton, NY (US)

( * ) Notice: Subject to any disclaimer, the term of this patent is extended or adjusted under 35 U.S.C. 154(b) by 233 days.

(21) Appl. No.: 14/488,658

(22) Filed: Sep. 17, 2014

(51) Int. Cl.
*A63B 21/00* (2006.01)
*A63B 69/32* (2006.01)

(52) U.S. Cl.
CPC ..... *A63B 69/32* (2013.01)

(58) Field of Classification Search
CPC ..... A63B 21/00
USPC ..... 482/83, 84, 85, 86, 87, 88, 89, 90
See application file for complete search history.

(56) References Cited

U.S. PATENT DOCUMENTS 5,700,230 A 12/1997 Cardona
7,416,517 B2 8/2008 Mitchell
8,079,938 B2 12/2011 Jones et al.
8,348,815 B2 1/2013 Signorino

*Primary Examiner* — Jerome W Donnelly
(74) *Attorney, Agent, or Firm* — Crossley & Stevenson Intellectual Property Law

(57) ABSTRACT

The boxing training device is a striking machine with a pair of identical spaced apart upright members affixed to the adjustable base. A block is affixed to the uprights most proximal the top end with a head removably disposed on the block. The head can be selectively fitted with a display unit that offers electronic feedback to the user. An upper impact pad can replace the display unit. A crossbar is affixed to the double action spring hinge of the head. The crossbar has a removable impact pad on each end such that a strike on either pad causes a counterstrike from the opposite pad, as the crossbar provides resisted horizontal rotation about the head via the hinge. Various impact pads are provided and interaction is offered a user with metered measurement and recording of activity, with further interaction available for interplay with existing electronic media and devices.

7 Claims, 8 Drawing Sheets

BOXING TRAINING DEVICE

BACKGROUND OF THE INVENTION

Various types of sport specific athletic training apparatuses are known in the prior art. Most are purely mechanical and often quite basic, such as a punching bag, hanging punching bag, or the like. Some are more complex yet none offer what is needed to fully engage a boxer or martial artist. Continual and progressive engagement of these athletes requires a combatative offering that can even counter react to a trainee. For example, should a boxer or martial artist throw a kick or punch, great training benefit is to be derived from a device that forces the trainee to expect a counter punch in return, often from an opposed direction. Further, today's athlete both needs and expects electronic feedback as well as interactive abilities with regard to existing external media and other electronic devices in order to enhance training and gaming experiences. Not only does engagement with external devices provide more enjoyable training, external engagement also provides for faster and more effective learning and enjoyment.

What is needed is a boxing and martial arts training device that fulfills these requirements, advantages provided by the current boxing training device.

FIELD OF THE INVENTION

The present invention relates to sport specific athletic training devices, and more particularly, to a boxing training device that aids any athlete and most importantly those training more specifically for boxing and martial arts.

SUMMARY OF THE INVENTION

The general purpose of the present boxing training device, described subsequently in greater detail, is to provide a boxing training device that has many novel features that result in a boxing training device which is not anticipated, rendered obvious, suggested, or even implied by prior art, either alone or in combination thereof.

To accomplish this, the boxing training device comprises a striking machine having a top end spaced apart from a bottom end. The device is provided in a basic mechanical form and fully mechanical and electronic form. The striking machine further comprises a hollow tubular front base spaced apart from a hollow tubular rear base, each disposed on the bottom end. A removable cap is disposed on an each end of each hollow tubular base. The hollow tubular front base and hollow tubular rear base, with removable caps, allow a weighted fill to be selectively added to aid in anchoring the device against inadvertent movement. A hydraulic cylinder is disposed between the hollow tubular front base and the hollow tubular rear base. A pair of identical spaced apart upright members is affixed to the hollow tubular front base. A plurality of spaced apart cross supports is disposed between and attached to the upright members. An adjustable length sleeved stanchion is affixed to the hollow tubular rear base. The adjustable length sleeved stanchion is removably disposed between the upright members. Importantly, the adjustable length sleeved stanchion and the hydraulic cylinder provide for a user to controllably adjust separation of front base and rear base for a widened or narrow stance of the device, without the aid of an assistant.

A CPU is removably disposed on one upright member. The ease of access and replacement of the CPU is an important feature of the device. A meter block is removably secured most proximal the top end between the upright members. The meter block is in operational communication with the CPU. A plurality of graduated meters is disposed within the meter block. A head is removably disposed on the meter block, most proximal the top end. A shielded spring is removably disposed on the head, opposite the meter block. A cam lock is disposed on the shielded spring. A stalk is removably retained by the cam lock. A lighted upper impact pad is disposed on the stalk. The lighted upper impact pad is in operational communication with the CPU.

Alternately to the shielded spring, a display unit is removably disposed on the head. A display is disposed within the display unit. The display and the display unit are in operational communication with the CPU and the meter block. A plurality of control buttons is disposed on the display unit. The control buttons are in operational communication with the display, the display unit, the graduated meters, and the CPU.

A double-action spring hinge is disposed within the head. A crossbar is affixed to the double action spring hinge. The crossbar has a first end spaced apart from a second end. A pair of opposed adjustably tensioned elastic bands are affixed to the head and the crossbar and provide for spring tension addition to the double-action spring hinge is regulating a force with which the crossbar's horizontal rotation occurs. A rectangular opening is disposed within each of the first end and the second end. A keyway is disposed within an each side of each rectangular opening. A female plug is disposed within each rectangular opening. A pair of identical rectangular insertion members is provided. A key is disposed on an each side of each rectangular insertion member. A male plug is disposed on each rectangular insertion member. One rectangular insertion member is removably disposed within each rectangular opening, respectively. One male plug is removably disposed within each female plug, respectively, with the insertion of the rectangular insertion member into the rectangular opening. A releasable retainer selectively secures each rectangular insertion member. The importance of removable insertion members is based upon a variety of impact pads offered and the ease of impact pad change. The keyed rectangular insertion members ensure against impact pad rotation.

A pair of lighted impact pads is provided. One of each lighted impact pad is affixed to one of each rectangular insertion member. An LED is disposed within each lighted impact pad. Each lighted impact pad and each LED is in operational communication with the display unit, the meter block, and the CPU. The display and the graduated meters are configured but not limited to illustrate a frequency, a power and a force of an impact on the lighted upper impact pad and the lighted impact pads. Importantly, the device is configured to operationally communicate and interact with a plurality of existing electronic, media and gaming devices.

Thus has been broadly outlined the more important features of the present boxing training device so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
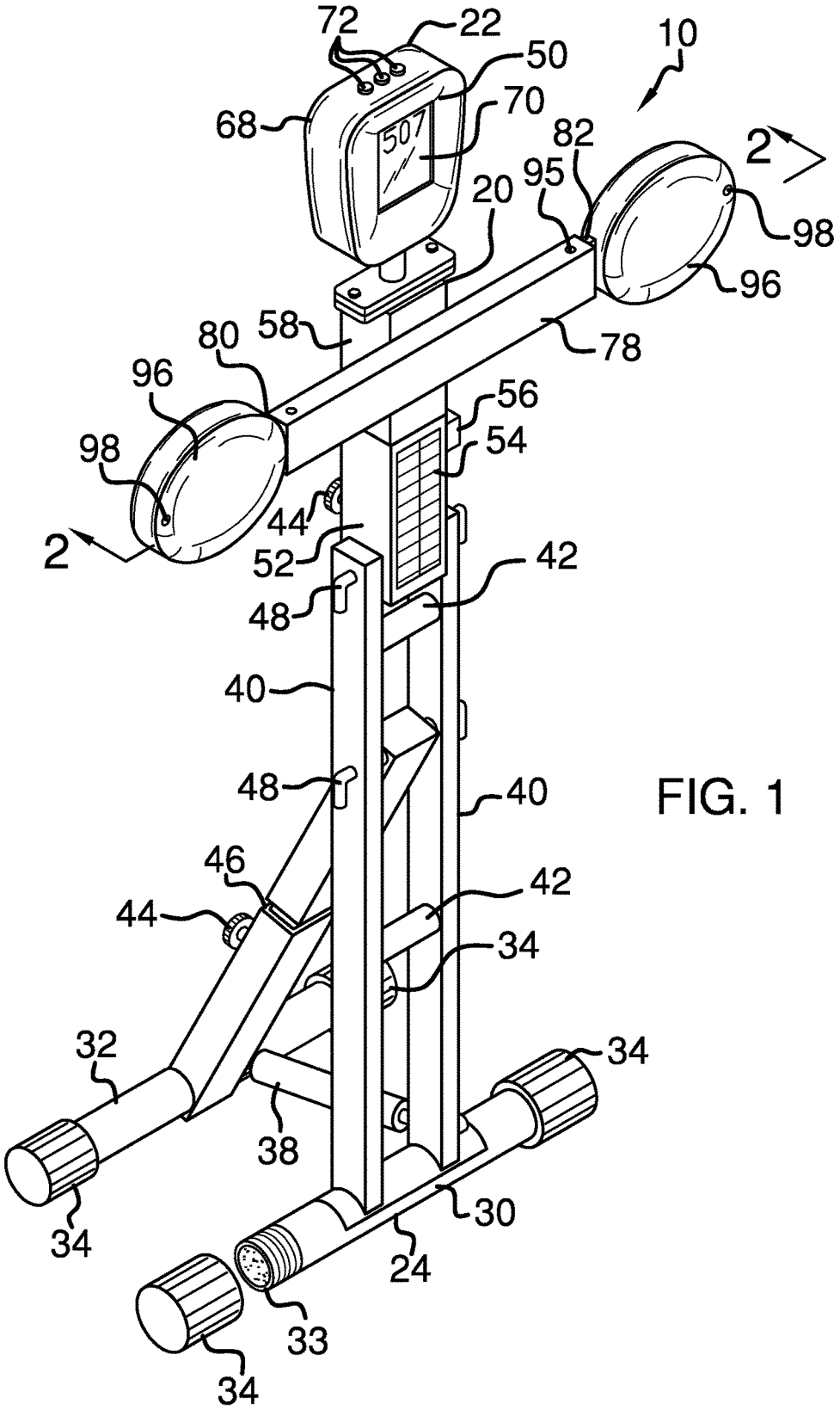
FIG. 1 is a perspective view.
Figure 2:
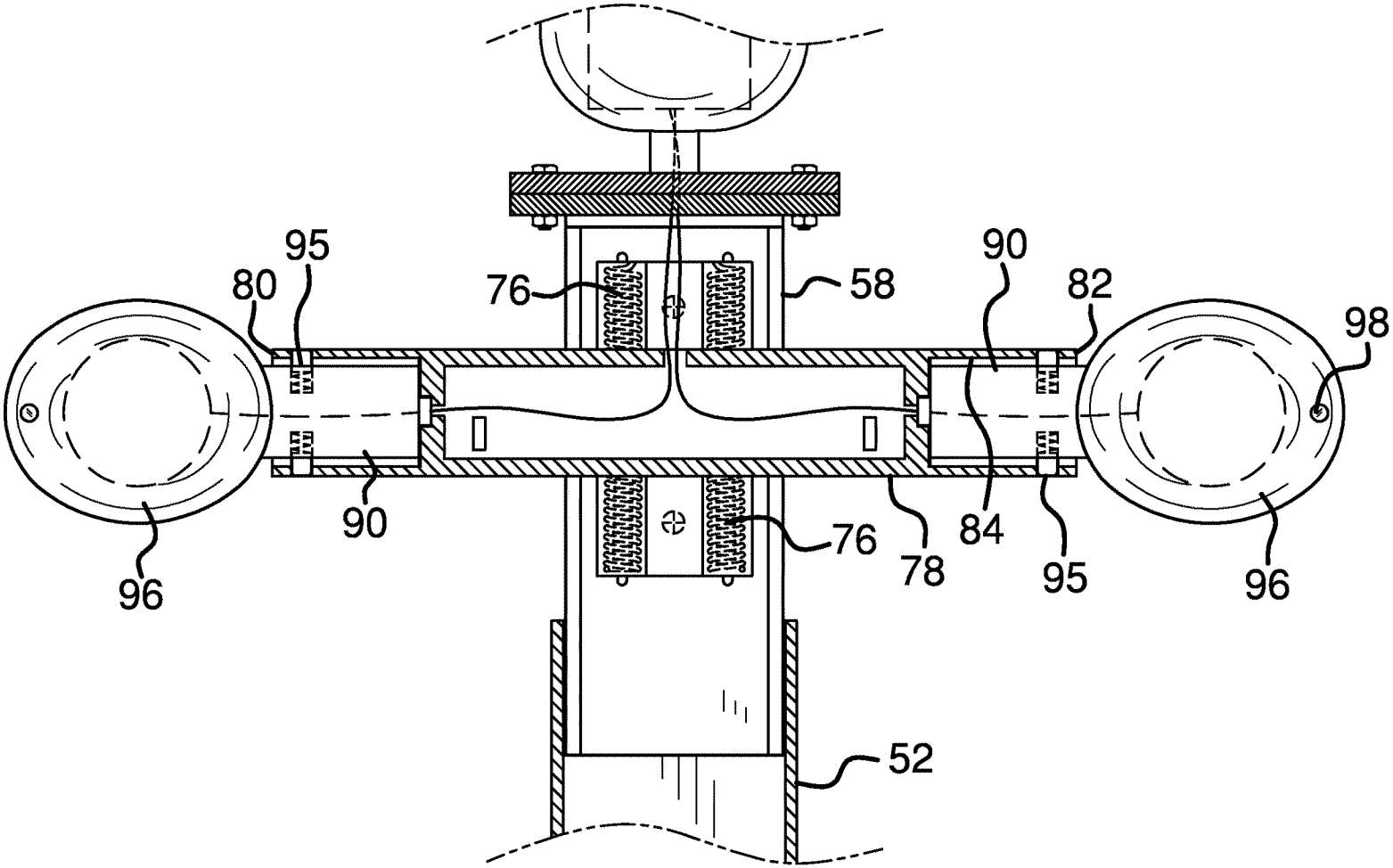
FIG. 2 is a partial cross sectional view.
Figure 3:
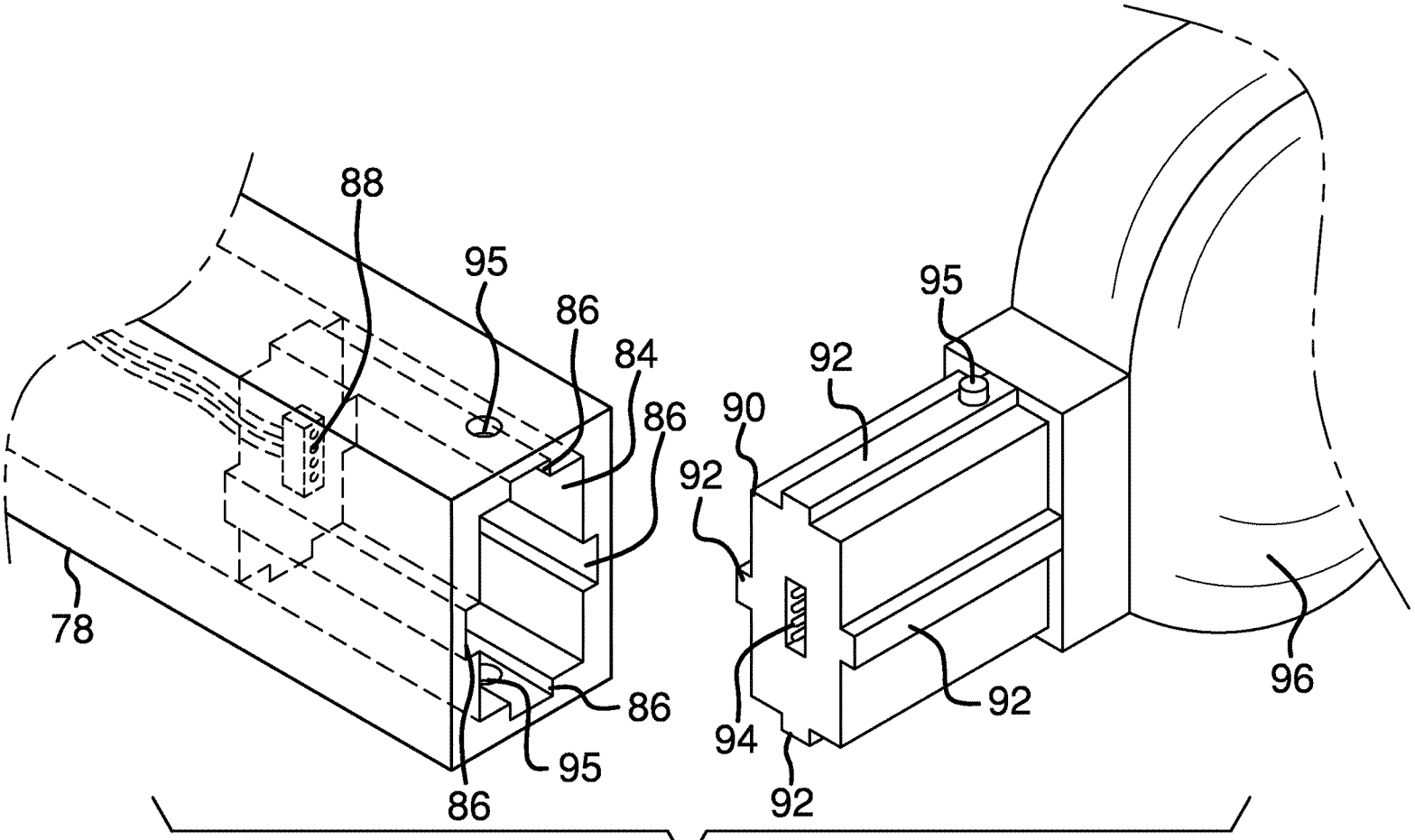
FIG. 3 is a partial detail view.
Figure 4:
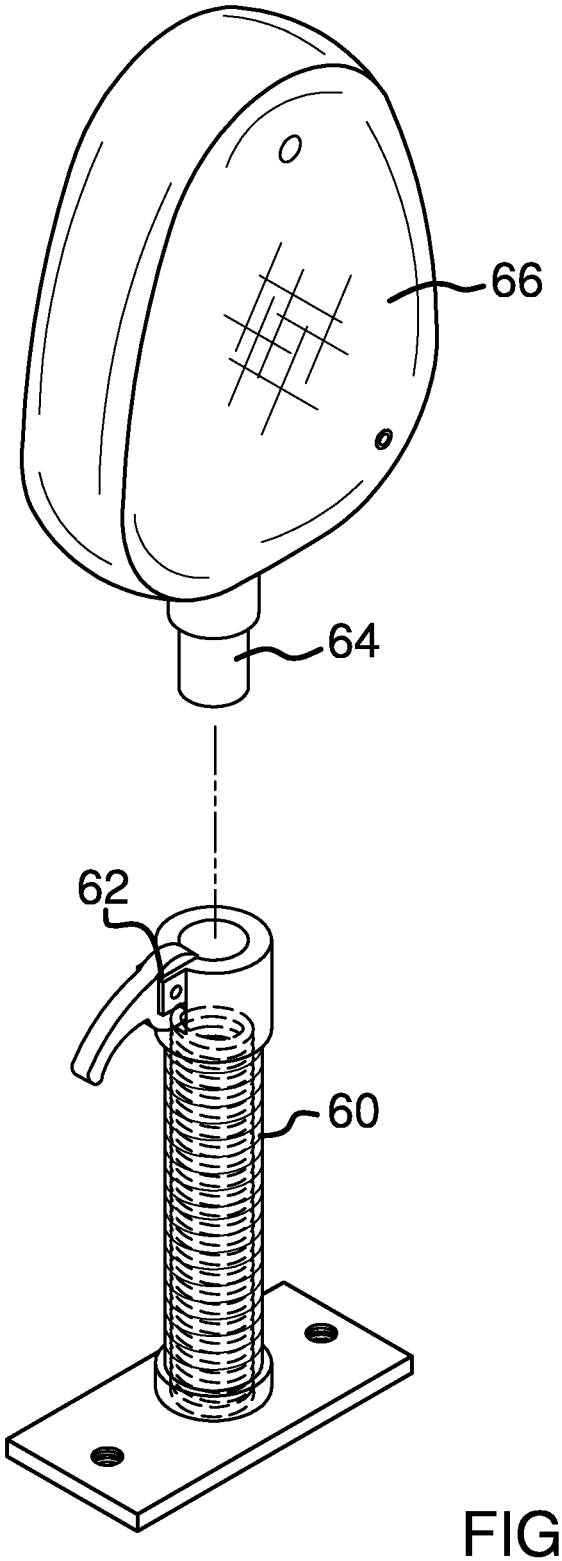
FIG. 4 is a perspective view of an upper impact pad and a shielded spring.
Figure 5:
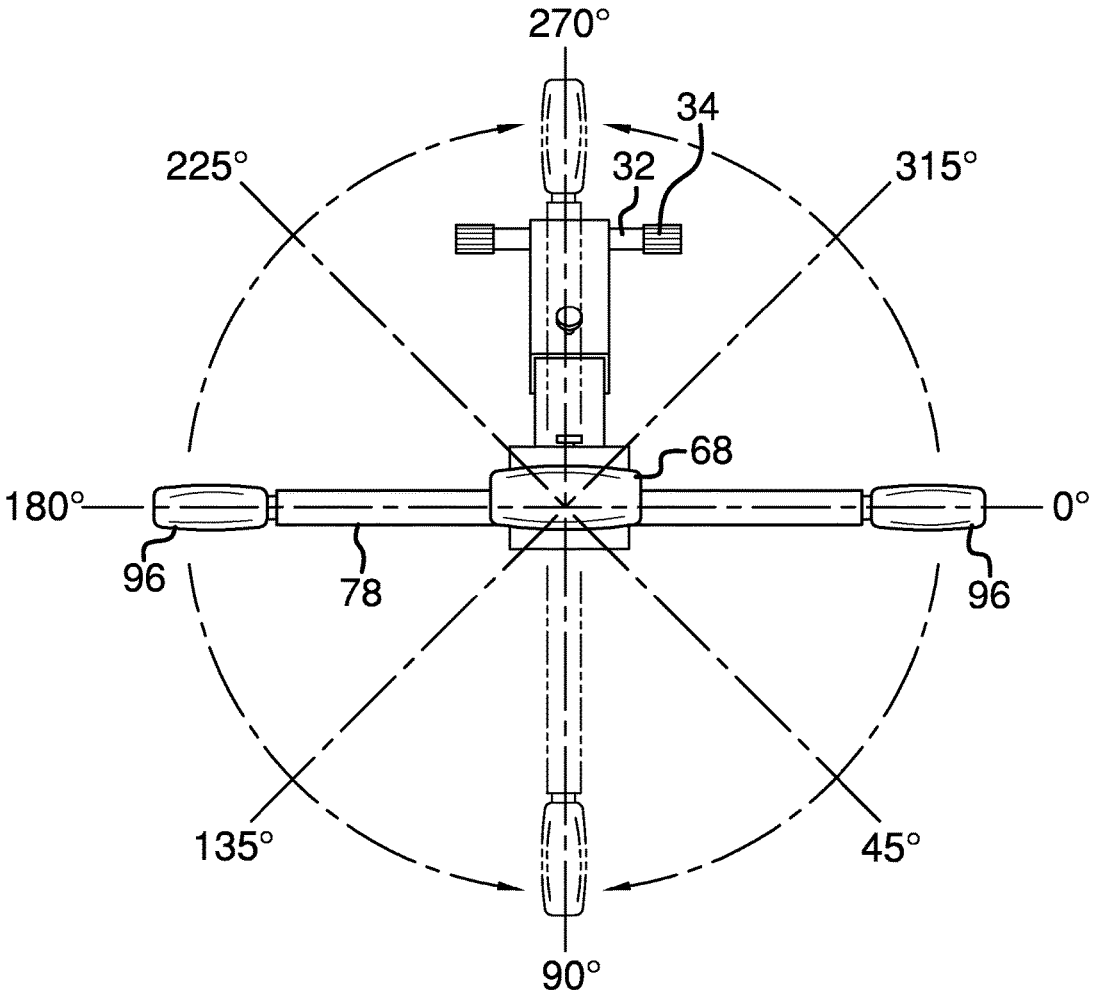
FIG. 5 is top plan view of a rotational travel of a crossbar.
Figure 6:
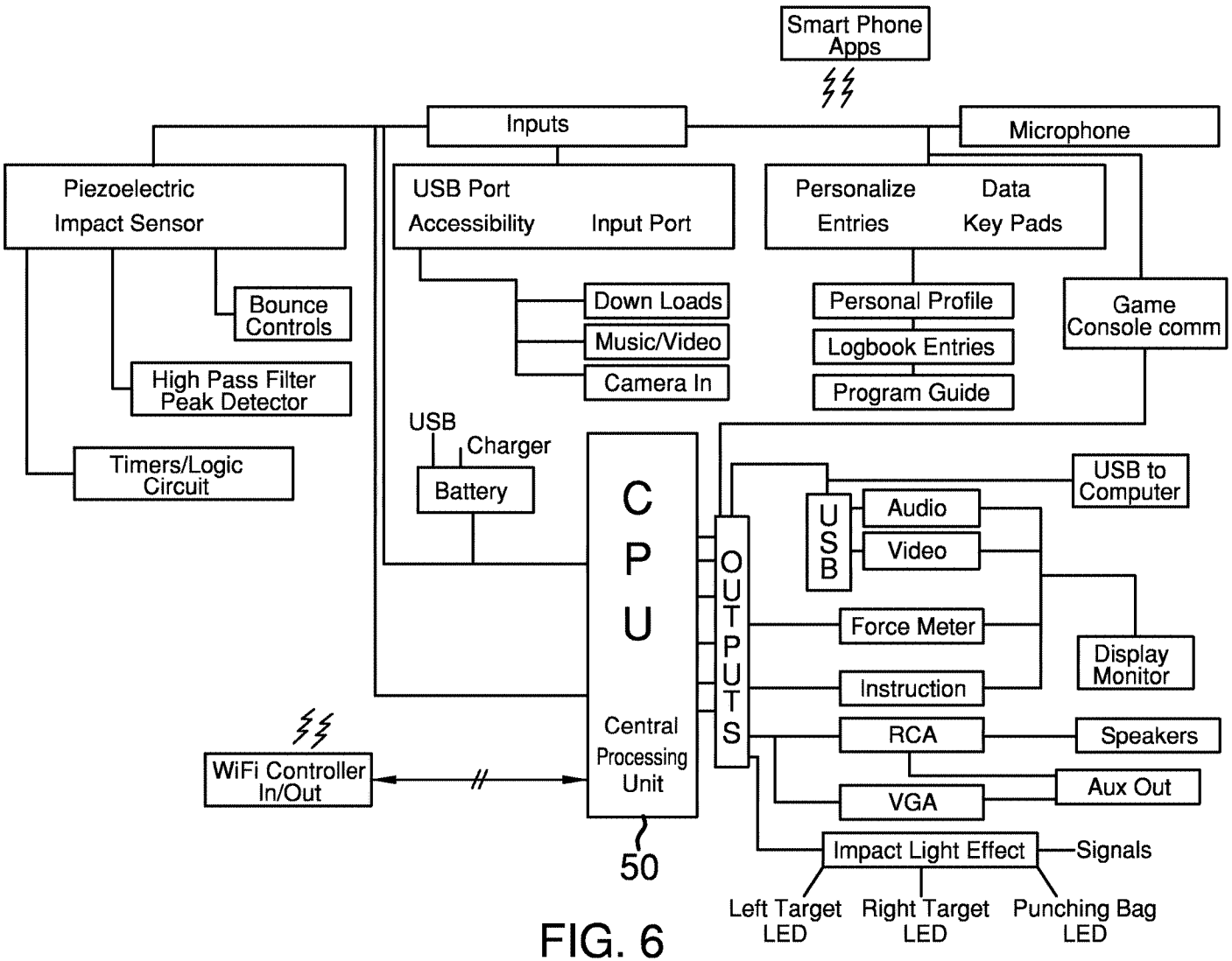
FIG. 6 is a schematic block diagram of a communication capability of a CPU.
Figure 7:
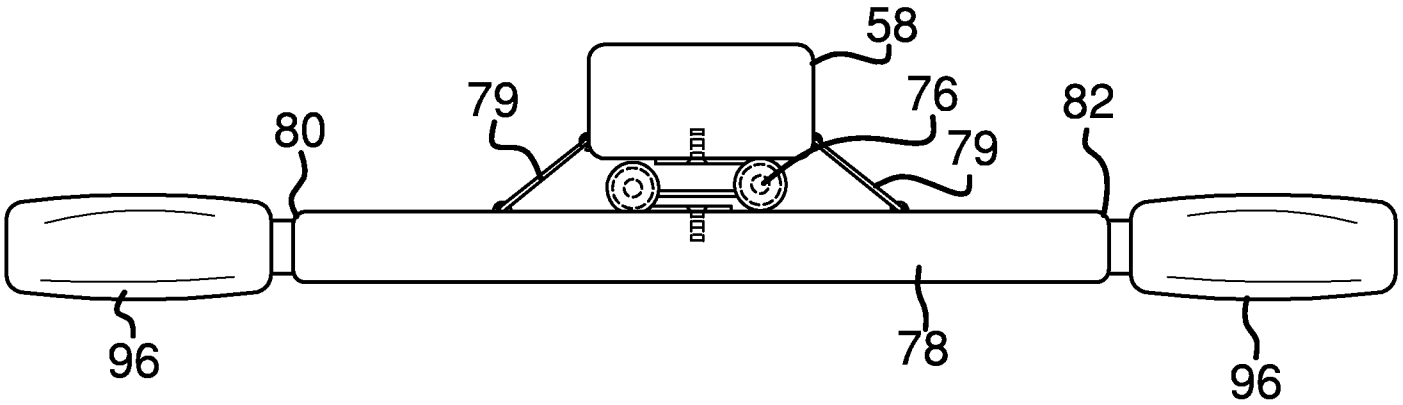
FIG. 7 is partial top plan view.
Figure 7A:
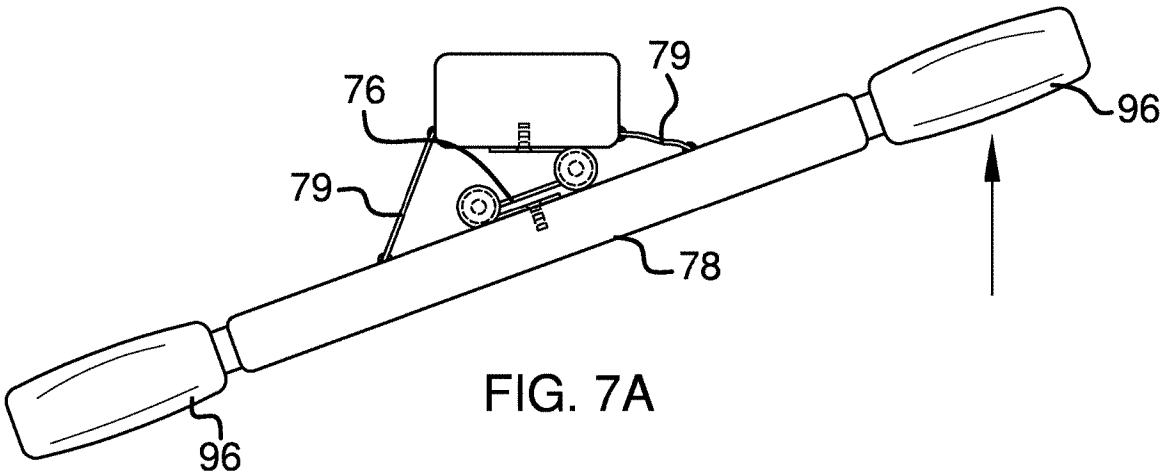
FIG. 7A is a partial top plan view with a crossbar right rotation.
Figure 7B:
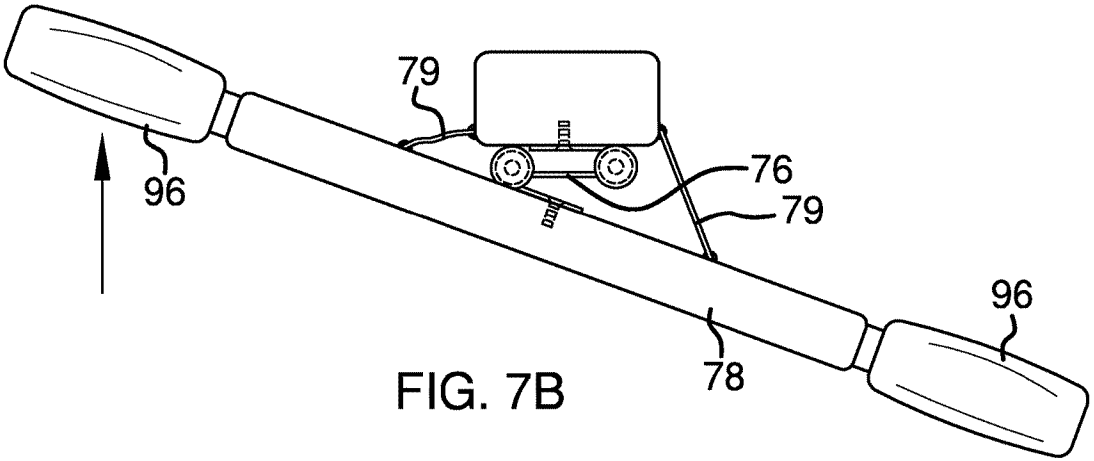
FIG. 7B is a partial top plan view with a left rotation of the crossbar.

With reference now to the drawings, and in particular FIGS. 1 through 7B thereof, an example of the boxing training device employing the principles and concepts of the present boxing training device and generally designated by the reference number 10 will be described.

Referring to FIGS. 1 through 7B, the boxing training device 10 is illustrated. The boxing training device 10 comprises a striking machine 20 having a top end 22 spaced apart from a bottom end 24. The striking machine 20 further comprises a hollow tubular front base 30 spaced apart from a hollow tubular rear base 32, each disposed on the bottom end 24. A removable cap 34 is disposed on an each outer end 33 of each of the front base 30 and the rear base 32. The hollow tubular front base 30 and hollow tubular rear base 32, with removable caps 34, allow a weighted fill to be selectively added to aid in anchoring the device 10 against inadvertent movement. A hydraulic cylinder 38 is disposed between the hollow tubular front base 30 and the hollow tubular rear base 32. A pair of identical spaced apart upright members 40 is affixed to the hollow tubular front base 30. A plurality of spaced apart cross supports 42 is disposed between and attached to the upright members 40. An adjustable length sleeved stanchion 46 is affixed to the hollow tubular rear base 32. A pair of adjustment knobs 44 is provided. One of the pair of adjustment knobs 44 provides for securing a desired dimension of the sleeved stanchion 46. The adjustable length sleeved stanchion 46 is removably disposed between the upright members 40. A plurality of removable retainers 48 provide for partial disassembly of the device 10.

A meter block 52 is removably secured most proximal the top end 22 between the upright members 40. A plurality of graduated meters 54 is disposed within the meter block 52. A head 58 is slidably engaged with the meter block 52, most proximal the top end 22. One of the pair of adjustment knobs 44 selectively secures the head 58 within the meter block 52 at a desired height, wherein the head 58 is height adjustable relative to the meter block 52. A shielded spring 60 is removably disposed on the head 58, opposite the meter block 52. A cam lock 62 is disposed on the shielded spring 60. A stalk 64 is removably retained by the cam lock 62. A lighted upper impact pad 66 is disposed on the stalk 64. The lighted upper impact pad 66 is in operational communication with the CPU 50.

Alternately to the shielded spring 60, a display unit 68 is removably disposed on the head 58. A display 70 is disposed within the display unit 68. The display 70 and the display unit 68 are in operational communication with a CPU 50 contained within the display unit 68 and the meter block 52. A plurality of control buttons 72 is disposed on the display unit 68. The control buttons 72 are in operational communication with the display 70, the display unit 68, the graduated meters 54, and the CPU 50. A double-action spring hinge 76 is disposed within the head 58. A crossbar 78 is affixed to the double action spring hinge 76. The crossbar 78 has a first end 80 spaced apart from a second end 82. A pair of adjustably tensioned elastic bands 79 is affixed to the head 58 and the crossbar 78. The springs of the double-action spring hinge 76 and the adjustably tensioned elastic bands 79 regulate a resistance to crossbar 78 rotation.

A rectangular opening 84 is disposed within each of the first end 80 and the second end 82. A keyway 86 is disposed within an each side of each rectangular opening 84. A female plug 88 is disposed within each rectangular opening 84. A pair of identical rectangular insertion members 90 is provided. A key 92 is disposed on an each side of each rectangular insertion member 90. A male plug 94 is disposed on each rectangular insertion member 90. One rectangular insertion member 90 is removably disposed within each rectangular opening 84, respectively. One male plug 94 is removably disposed within each female plug 88, respectively, with the insertion of the rectangular insertion member 90 into the rectangular opening 84. A releasable retainer 95 selectively secures each rectangular insertion member 90.

A pair of lighted impact pads 96 is provided. One of each lighted impact pad 96 is affixed to one of each rectangular insertion member 90. An LED 98 is disposed within each lighted impact pad 96. Each lighted impact pad 96 and each LED 98 is in operational communication with the display unit 68, the meter block 52, and the CPU 50. The display 70 and the graduated meters 54 are configured but not limited to illustrate a frequency, a power and a force of an impact on the lighted upper impact pad 66 and the lighted impact pads 96.

It is important to note that a trainee is exposed to an opposite direction counter strike by the rotational action of the crossbar 78 resisted by the double-action spring hinge 76 and the adjustably tensioned elastic band 79. Further, striking a lighted impact pad 96 sees a return strike whose tension and speed can be adjusted. A display of force and power of a strike is of great benefit to a trainee. The control buttons 72 provide for fully adjustable display 70 and graduated meter 54 visuals for a trainee. The device 10 is further configured to operationally communicate with a plurality of existing electronic, media, and gaming devices.

The meter block 52 further comprises a docking port 56 wherein a plurality of existing electronic media and gaming devices is selectively attached to the docking port 56. Further, the removable display unit 68 is selectively attached to the docking port 56. The display unit 68 is selectively in communication with the plurality of electronic media and gaming devices. Due to this feature, when the display unit 68 is removed from the head 58 and replaced by the lighted upper impact pad 66, the device 10 offers even more complete operational enjoyment and usefulness.

What is claimed is:

1. A boxing training device comprising:

a striking machine having a top end spaced apart from a bottom end;

a hollow tubular front base spaced apart from a hollow tubular rear base, each hollow tubular base disposed on the bottom end;

a cap removably disposed on an each end of each tubular base;

a hydraulic cylinder disposed between the hollow tubular front base and the hollow tubular rear base;

a pair of identical spaced apart upright members affixed to the hollow tubular front base;

a plurality of spaced apart cross supports disposed between and attached to the upright members;

an adjustable length sleeved stanchion affixed to the hollow tubular rear base, the sleeved stanchion removably disposed between the uprights;

a CPU removably disposed on one upright member;

a meter block removably secured most proximal the top end between the upright members, the meter block in operational communication with the CPU;

a plurality of graduated meters disposed within the meter block;

a head removably disposed on the meter block, most proximal the top end;

a shielded spring removably disposed on the head, opposite the meter block;

a cam lock disposed on the shielded spring;

a plurality of stalks removably retained by the cam lock;

a lighted upper impact pad disposed on each stalk, the lighted upper impact pad in operational communication with the CPU;

a double-action spring hinge disposed within the head;

a crossbar affixed to the double action spring hinge, the crossbar having a first end spaced apart from a second end;

wherein the crossbar is provided horizontal rotation about the head;

a pair of adjustably tensioned elastic bands affixed to the head and the crossbar;

a rectangular opening disposed within each end;

a keyway disposed within an each side of each rectangular opening;

a female plug disposed within each rectangular opening;

a plurality of identical rectangular insertion members;

a key disposed on an each side of each rectangular insertion member;

a male plug disposed on each rectangular insertion member;

wherein one rectangular insertion member is removably disposed within each rectangular opening, respectively, one male plug removably disposed within each female plug, respectively;

a releasable retainer selectively securing each rectangular insertion member;

a plurality of lighted impact pads, one of each lighted impact pad attached to one of each rectangular insertion member; and an LED disposed within each pad;

wherein each lighted impact pad and each LED is in operational communication with the display unit, the meter block, the CPU; and wherein the display is configured to illustrate a frequency, a power and a force of an impact on the lighted upper impact pad, the lighted impact pads.

2. A boxing training device comprising:

a striking machine having a top end spaced apart from a bottom end;

a hollow tubular front base spaced apart from a hollow tubular rear base, each hollow tubular base disposed on the bottom end;

a cap removably disposed on an each end of each tubular base;

a hydraulic cylinder disposed between the hollow tubular front base and the hollow tubular rear base;

a pair of identical spaced apart upright members affixed to the hollow tubular front base;

a plurality of spaced apart cross supports disposed between and attached to the upright members;

an adjustable length sleeved stanchion affixed to the hollow tubular rear base, the sleeved stanchion removably disposed between the uprights;

a pair of adjustment knobs, one of the pair of adjustment knobs selectively securing the adjustable length sleeved stanchion;

a CPU removably disposed on one upright member;

a meter block removably secured most proximal the top end between the upright members, the meter block in operational communication with the CPU;

a plurality of graduated meters disposed within the meter block;

a head removably disposed on the meter block, most proximal the top end;

a shielded spring removably disposed on the head, opposite the meter block;

a cam lock disposed on the shielded spring;

a stalk removably retained by the cam lock;

a lighted upper impact pad disposed on the stalk, the lighted upper impact pad in operational communication with the CPU;

a display unit removably disposed on the head, opposite the meter block;

a display disposed within the display unit, the display and the display unit in operational communication with the CPU and the meter block;

a plurality of control buttons disposed on the display unit, the control buttons in operational communication with the display, the display unit, the graduated meters, and the CPU;

a double-action spring hinge disposed within the head;

a crossbar affixed to the double action spring hinge, the crossbar having a first end spaced apart from a second end;

wherein the crossbar is provided horizontal rotation about the head;

a pair of adjustably tensioned elastic bands affixed to the head and the crossbar;

a rectangular opening disposed within each end;

a keyway disposed within an each side of each rectangular opening;

a female plug disposed within each rectangular opening;

a pair of identical rectangular insertion members;

a key disposed on an each side of each rectangular insertion member;

a male plug disposed on each rectangular insertion member;

wherein one rectangular insertion member is removably disposed within each rectangular opening, respectively, one male plug removably disposed within each female plug, respectively;

a releasable retainer selectively securing each rectangular insertion member;

a plurality of lighted impact pads, one of each impact pad attached to one of each rectangular insertion member; and an LED disposed within each pad;

wherein each lighted impact pad and each LED is in operational communication with the display unit, the meter block, the CPU; and wherein the display is configured to illustrate a frequency, a power and a force of an impact on the lighted upper impact pad, the lighted impact pads.

3. The device of claim 2 further configured to operationally communicate with a plurality of existing electronic media and gaming devices.

4. The device of claim 2 wherein the head is slidably engaged with the meter block;

one of the pair of adjustment knobs selectively securing the head within the meter block;

wherein the head is height adjustable relative to the meter block.

5. The device of claim 3 wherein the head is slidably engaged with the meter block;

one of the pair of adjustment knobs selectively securing the head within the meter block;

wherein the head is height adjustable relative to the meter block.

6. The device of claim 3 wherein the meter block further comprises a docking port;

wherein the plurality of existing electronic media and gaming devices is selectively attached to the docking port; and wherein the display unit is selectively attached to the docking port.

7. The device of claim 4 wherein the meter block further comprises a docking port;

wherein the plurality of existing electronic media and gaming devices is selectively attached to the docking port; and wherein the display unit is selectively attached to the docking port.

* * * * *